US009486015B2

(12) United States Patent
Shinn et al.

(10) Patent No.: US 9,486,015 B2
(45) Date of Patent: Nov. 8, 2016

(54) UNDERGARMENT COMPRISING SLEEVE POCKET FOR TAMPON

(71) Applicant: DREAMKASSH ENTERTAINMENT LLC, Ashburn, VA (US)

(72) Inventors: Stephanie Shinn, Ashburn, VA (US); Jammal Brown, Ashburn, VA (US)

(73) Assignee: DREAMKASSH ENTERTAINMENT LLC, Ashburn, VA (US)

( * ) Notice: Subject to any disclaimer, the term of this patent is extended or adjusted under 35 U.S.C. 154(b) by 282 days.

(21) Appl. No.: 14/057,520

(22) Filed: Oct. 18, 2013

(65) Prior Publication Data

US 2014/0259306 A1 Sep. 18, 2014

Related U.S. Application Data

(60) Provisional application No. 61/792,903, filed on Mar. 15, 2013.

(51) Int. Cl.
*A41B 9/00* (2006.01)
*A41B 9/04* (2006.01)

(52) U.S. Cl.
CPC . *A41B 9/04* (2013.01); *A41B 9/001* (2013.01)

(58) Field of Classification Search
CPC .... A41B 9/04; A41D 27/207; A61F 13/496; A61F 13/4963; A61F 13/4966; A61F 13/15
USPC ..... 2/73, 78.1, 109, 400, 403, 406
See application file for complete search history.

(56) References Cited

U.S. PATENT DOCUMENTS 2,544,840 A * 3/1951 Kowatsch ..... A41D 7/005 2/252
2,822,807 A * 2/1958 Heyman ..... A41B 9/02 2/404
D283,077 S * 3/1986 Crandall ..... D2/738
5,067,178 A * 11/1991 Katchka ..... A41B 9/001 2/247
5,093,935 A * 3/1992 Countee, Jr. ..... A41B 9/02 2/247
5,172,430 A * 12/1992 Lerma-Solis ..... A41B 9/02 128/842
8,100,876 B1 * 1/2012 Biondolillo ..... A41B 9/04 604/385.02
2003/0101502 A1 * 6/2003 Hayes ..... A41D 27/20 2/78.1
2004/0083538 A1 * 5/2004 Thomas ..... A41D 27/201 2/400
2008/0189832 A1 * 8/2008 Oscher ..... A41B 9/002 2/400
2009/0104845 A1 * 4/2009 Pintor ..... A41C 3/0035 450/31
2010/0281595 A1 * 11/2010 Gernes ..... A41B 9/001 2/69
2012/0082809 A1 * 4/2012 Fleeman ..... B32B 1/02 428/35.5
2012/0276812 A1 * 11/2012 Wollowick ..... A45F 5/02 450/89
2013/0018350 A1 * 1/2013 McNulty ..... A61F 13/56 604/385.03
2013/0046258 A1 * 2/2013 Chambers ..... A61F 5/453 604/349

* cited by examiner

*Primary Examiner* — Khaled Annis
(74) *Attorney, Agent, or Firm* — Kilyk & Bowersox, P.L.L.C.

(57) ABSTRACT

An under pant garment is provided that includes a sleeve pocket. The sleeve pocket can have an opening and be configured to retain a tampon-with-applicator. The opening can be at least partially defined by an elastic member. The sleeve pocket can have a sleeve, and the sleeve can be secured to the under pant garment at the opening, at one or more other locations, or at the opening and at one or more other locations. The sleeve pocket can be reversible. The sleeve pocket can be positioned where the under pant garment is designed to contact the crease between a user's inner thigh and the user's abdomen. The sleeve pocket can be elongated along the crease.

10 Claims, 5 Drawing Sheets

UNDERGARMENT COMPRISING SLEEVE POCKET FOR TAMPON

CROSS-REFERENCE TO RELATED APPLICATION

This application claims the benefit of earlier filed provisional application No. 61/792,903, filed Mar. 15, 2013, which is incorporated herein in its entirety by reference.

FIELD

The present invention relates to undergarments, and pockets configured to fit a tampon.

BACKGROUND OF THE INVENTION

Throughout history, women's menstrual cycles have always been a time of discomfort and embarrassment. As an example that most every woman and most teenage girls can relate to, menstrual cycles are sometimes difficult to predict. Most women never know the exact time when they are going to start their period. Usually, a woman only has a general idea of the day or days around the estimated "start" date of her menstrual cycle.

Often times a woman's menstrual cycle can begin at an unexpected time. Sometimes, a woman is not prepared for the start of a menstrual cycle. Sometimes, the reason for not being prepared is that it is not convenient to carry a tampon on oneself. Packaged tampons, including an applicator, are bulky, cumbersome, rigid, and not easily disguised or hidden. Often times, a trip to the bathroom for the purpose of applying or changing a tampon or pad requires a trip to a locker, a trip to a car, digging through a purse or backpack, or the need to ask someone else for an appropriate hygienic device.

The menstrual cycle is a most embarrassing and uncomfortable time for girls in the age group of from 12 years-old to 18 years-old. It would be beneficial to provide a convenient yet unnoticeable way of storing a tampon on one's self, so it can be ready for use in short order.

SUMMARY OF THE PRESENT INVENTION

According to one or more embodiments of the present invention, an undergarment comprising a sleeve pocket configured to secure a hygienic device, is provided. The hygienic device can be a tampon, a pad, another device for absorbing menstrual bleeding, or the like. The sleeve pocket can be elongated. The sleeve pocket can have at least one opening. The at least one opening to the sleeve pocket can be accessible from the exposed surface of the undergarment. The at least one opening to the sleeve pocket can be accessible from the inner, or skin-contacting, surface of the undergarment. In some cases, the sleeve pocket is attached only at its opening, to the remainder of the undergarment. In some embodiments, the sleeve pocket can have a free distal end, or bottom, such that the sleeve pocket can be reversible and the opening can be accessible from either the exposed surface or the inner surface of the undergarment.

The pouch can stretch in size, and holds a tampon securely in place without the fear of having the tampon fall out. A stretch material and/or elastic member can be used, at least as part of the sleeve pocket or undergarment.

According to the present invention, a woman can benefit from having a tampon secured in a compact pouch or sleeve pocket of an undergarment, ready for whenever her menstrual cycle begins. The convenience enabled by the present invention helps avoid problems such as being in the restroom without a tampon but in need of one, or having to quickly find a tampon, or someone that has one, and then going to or returning to the restroom.

It is to be understood that both the foregoing general description and the following detailed description are exemplary and explanatory only and are intended to provide a further explanation of the present invention, as claimed.

DETAILED DESCRIPTION OF THE PRESENT INVENTION

Figure 1:
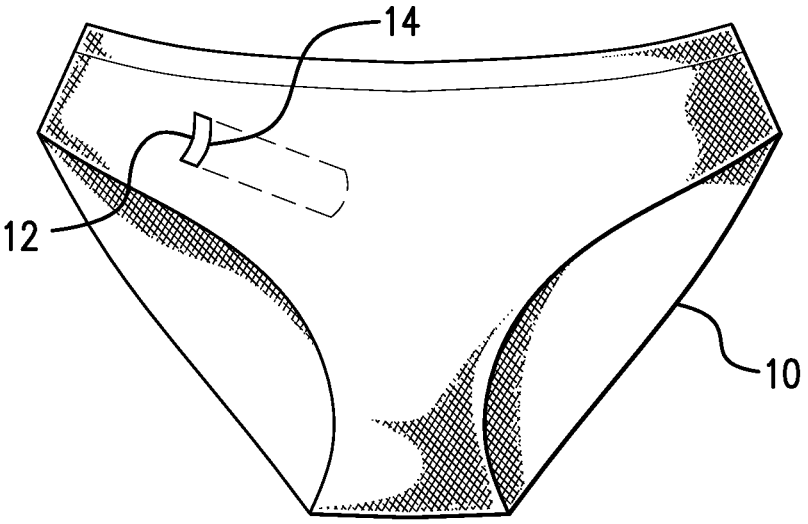
FIG. 1 is a front view of a bikini style panty undergarment comprising a sleeve pocket, in accordance with various embodiments of the present invention.

According to various embodiments of the present invention, the undergarment can comprise underwear, underpants, an under pant garment, swimwear, a girdle, yoga pants, leggings, or the like, comprising a sleeve pocket. While some of these clothes like swimwear are not typically worn as undergarments, it is to be understood that "undergarment" as described herein can include these clothes, for example, swim wear in the form of a bikini bottom or a one-piece bathing suit. According to one or more embodiments of the present invention, the undergarment can comprise underwear, a panty, a bikini style panty, a hipster style panty, a brief style panty, a thong style panty, a boyshort style panty, a camisole, a bodysuit, or the like.

The opening to the sleeve pocket can be positioned anywhere on the undergarment. In some embodiments, the opening to the sleeve pocket is positioned at or near where the undergarment touches the intersection of the inner thigh and the abdomen of the wearer. The opening can be situated along the crease between the inner thigh and the abdomen of the wearer and the sleeve pocket can extend in a direction along the crease. The sleeve pocket can extend along the crease downwardly, upwardly, or both. In some cases, the sleeve pocket can have two openings, for example, at two opposite ends of the sleeve pocket.

The sleeve pocket can be of any suitable length, width, depth, dimension, material, or construction that enables the sleeve pocket to securely retain a tampon, for example, a tampon with applicator, wrapped in a protective wrapper, a telescoping tampon-with-applicator, or the like. The sleeve pocket can comprise an opening and can be configured for retaining a tampon-with-applicator. The opening can be at least partially defined by an elastic member. The sleeve pocket can comprise the opening and a sleeve. In cases where the sleeve can be secured to the undergarment only at the opening, the sleeve pocket can be reversible. The sleeve pocket can be positioned where the undergarment is designed to be in contact with the crease between a user's inner thigh and the user's abdomen. The sleeve pocket can be elongated along the crease. The sleeve pocket can be attached to the undergarment at the opening and at one or more other locations. The one or more other locations can include at least a distal end of the sleeve pocket. The sleeve pocket can comprise the same material as the remainder of the undergarment, or the sleeve pocket can comprise a different material than the remainder of the undergarment.

The sleeve pocket can have a length of from about 2.0 inches to about 5.0 inches, for example, from about 3.0 inches to about 4.0 inches. The sleeve pocket opening can have a width of from about 0.5 inch to about 2.0 inches, for example, from about 0.5 inch to about 1.0 inch, or about 0.75 inch.

The present invention also encompasses a set of undergarments wherein each undergarment of the set comprises a sleeve pocket configured to secure a hygienic device. The set includes at least one relatively larger-sized undergarment and at least one relatively smaller-sized undergarment. In some cases, the sleeve pockets of the undergarments of the set can all have the same size. The sleeve pockets can all be situated in generally the same location, regardless of the size of the undergarment. In some cases the sleeve pocket of one or more larger-sized undergarments of the set can have a length that is greater than the length of the sleeve pocket of one or more of the relatively smaller-sized garments of the set. The set can be tailored such that larger-sized undergarments of the set can be configured with larger sleeve pockets and can be optimized to securely maintain larger-sized tampon-with-applicator devices. Similarly, the set can be tailored such that smaller-sized undergarments of the set can be configured with smaller sleeve pockets optimized to securely retain smaller-sized tampon-with-applicator devices. An example of a smaller-sized tampon-with-applicator device is a device that includes a telescoping tampon applicator. Plastic, cardboard, or other types of tampon-with-applicator devices can be stored, carried, or otherwise retained in the sleeve pocket.

The undergarment, and/or the sleeve pocket, can comprise any suitable material. Exemplary materials that can be used include cotton, linen, SPANDEX, polyester, rayon, NYLON, RAGADON, ELASTONE, modal, silk, satin, leather, LYCRA, bamboo, hemp, dry-fit materials, wicking materials, breathable materials, blends of such materials, and the like materials. Organic materials can be used. The material can be harmless to women's bodies. The material can be comfortable.

The undergarment can have the sleeve pocket sewn into the panty, like a conventional pocket or sleeve. When worn by a wearer standing upright, the sleeve pocket can be angled with respect to a vertical line, at an angle Θ. Angle Θ could be any angle that provides a comfortable fit for a wearer, particularly when a tampon is in sleeve pocket 61. In some cases, angle Θ can be from about 20° to about 60°, from about 30° to about 50°, from about 35° to about 45°, or from about 38° to about 42°. In some cases, angle Θ can be about 20°. In some cases, the sleeve pocket can be located horizontally between the hipbone and pubic bone, or slightly angled, for example, up to 80°, up to 60°, up to 40°, up to 20°, or up to 10°, with respect to the horizon. When worn by a wearer standing upright, the bottom of the sleeve pocket can be lower than the opening of the sleeve pocket, although opposite embodiments are also provided according to the present invention.

The sleeve pocket can be stretchy enough to hold a tampon-with-applicator securely in place, and can stretch to the size of the packaged tampon-with-applicator. In some sets of undergarments, like a set on display for sale at a retail store, all of the sleeve pockets of all of the undergarments in the set can have the same sized sleeve pocket, or different undergarments can have different sized sleeve pockets. The sleeve pocket in each undergarment of a set can fall in the same place on each wearer, and in some cases the sleeve pocket in each undergarment of a set can fall in the same place on each wearer, no matter the size of the panty. In some cases, the sleeve pocket can be proportionately the same size for each sized panty of the set.

The sleeve pocket can be configured to retain a particular size of tampon-with-applicator, but can nonetheless be capable of retaining other sizes of tampon-with-applicators. For example, the sleeve pocket can be of a length configured to fully contain a lite flow-sized tampon-with-applicator whereas a heavy flow-sized tampon-with-applicator might protrude from the sleeve pocket. Even if the tampon-with-applicator protrudes, however, the sleeve pocket can be constructed to retain the tampon-with-applicator. The sleeve pocket can comprise an elastic material, a stretch material, a rubber material, a stretchy elastic material, or the like. The sleeve pocket can comprise a different material than the rest of the undergarment, or it can be made of the same material as the rest of the undergarment. One or more openings to the sleeve pocket can comprise an elastic material, a stretch material, a rubber material, or the like. The sleeve pocket can comprise a liner or can be made of an opaque material that disguises the pocket so that a colored tampon wrapper cannot be seen through the undergarment.

In some embodiments, the sleeve pocket can include a closure device, such as a zipper, a hook and loop fastener, a snap, a button, a snap rivet, VELCRO, adhesive, ZIP-LOC closure, or the like. The sleeve pocket can be formed of waterproof material and can include a water-tight closure device so that a tampon stored inside the pocket does not get wet, even if the undergarment is swimwear.

As an example of the usefulness of the present invention, a high school girl is in school and begins her period. She asks her teacher to use the restroom. She has to take her purse or backpack with her, where a tampon is stored, and now she is embarrassed because she feels that others at school knows she is having her period. The girl may also have to go to her locker before going to the restroom, to retrieve her tampon. Her teacher may stop the girl and ask where she is going, for example, especially if the restroom is in a different direction. The girl would be embarrassed and uncomfortable. If, however, the girl had a tampon stored in an undergarment, no one would know and no extra trip to a locker or elsewhere would be necessary.

As another example of the usefulness of the present invention, women of the ages from 18 to 30 include college students and young working adults. These women are busy with work and social schedules, always on the go. The undergarments of the present invention are extremely helpful in situations of classes, partying, work, and dinner with friends.

In an example, a young college student decides to go to a bar with her girlfriends. She hates carrying a purse and typically likes to keep her ID and money in her pocket; however, she is on her period and needs a place for her tampon. Previously, she would be forced to carry her purse, but with the undergarment of the present invention, she can leave her purse at home and simply secure a tampon in the sleeve pocket, compact pouch of her panty.

For women in the age group of from 30 to 55, there are many mothers and working women. These women are extremely busy and always on the go. The undergarment of the present invention offers great benefits for these women.

In an example, a mother of three is always in a rush. She has a young baby and instead of using a purse she carries her large diaper bag everywhere. When she is on her period, she hates toting her diaper bag to the restroom, fumbling through to find a tampon that might be buried in the diaper bag. It would be very helpful if she had a tampon securely slid into the sleeve pocket of her panty.

These are just some examples how each group of women can greatly benefit from the present invention. Girls and women everywhere and of all ages can benefit from the present invention.

With reference now to the drawings, FIG. 1 is a front view of a bikini style panty undergarment 10 comprising a sleeve pocket 12, in accordance with various embodiments of the present invention. As with the other styles of undergarment described herein, sleeve pocket 12 does necessarily have to be situated on the right side of the wearer. Moreover, the angle of sleeve pocket 12 relative to horizontal or vertical, with respect to a wearer, can be at other angles than that shown. Sleeve pocket 12 can comprise a single flap 14 at the opening thereof, and the flap can comprise an elastic material in some embodiments.

Figure 2:
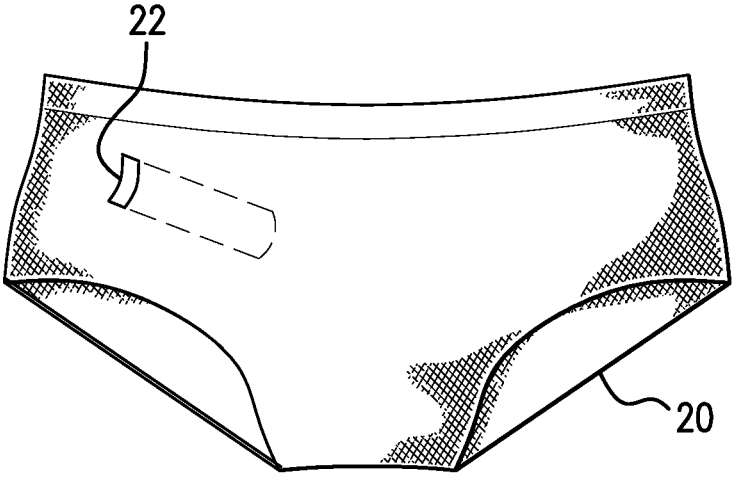
FIG. 2 is a front view of a hipster style panty undergarment comprising a sleeve pocket, in accordance with various embodiments of the present invention.

FIG. 2 is a front view of a hipster style panty undergarment 20 comprising a sleeve pocket 22, in accordance with various embodiments of the present invention.

Figure 3:
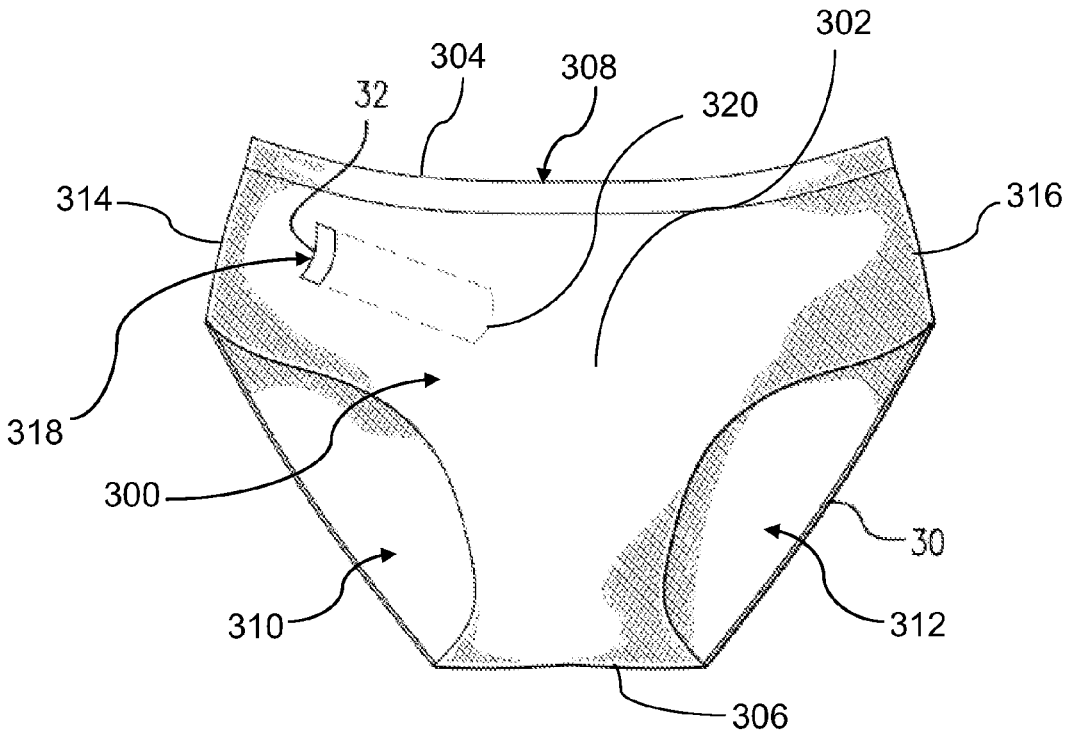
FIG. 3 is a front view of a brief style panty undergarment comprising a sleeve pocket, in accordance with various embodiments of the present invention.

FIG. 3 is a front view of a brief style panty undergarment 30 comprising a sleeve pocket 32, in accordance with various embodiments of the present invention.

As can be seen in FIG. 3, the girl's panty comprises an undergarment and a sleeve pocket. The undergarment has a garment front 300, a garment front center 302, a garment top 304, a garment bottom 306, a torso opening 308 at garment top 304, a pair of leg openings 310, 312 that intersect with garment bottom 306, a first garment side 314, and a second garment side 316. As can also be seen in FIG. 3, the sleeve pocket has a length and a width and comprises a pocket opening 318 and a pocket bottom 320. Pocket opening 318 comprises an elastic material and is attached to undergarment 30 at garment front 300 adjacent to garment top 304 and first garment side 314. As shown, sleeve pocket 32 is elongated in a first direction from pocket opening 318 to pocket bottom 320 and angled downwardly diagonally along garment front 300 toward garment front center 302.

Figure 4:
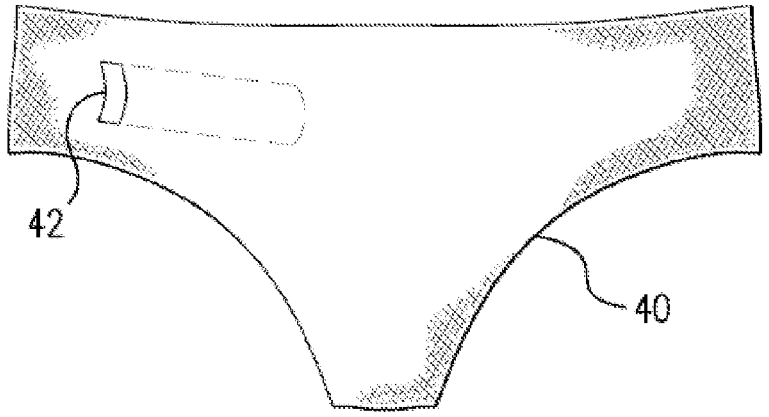
FIG. 4 is a front view of a thong style panty undergarment comprising a sleeve pocket, in accordance with various embodiments of the present invention.

FIG. 4 is a front view of a thong style panty undergarment 40 comprising a sleeve pocket 42, in accordance with various embodiments of the present invention.

Figure 5:
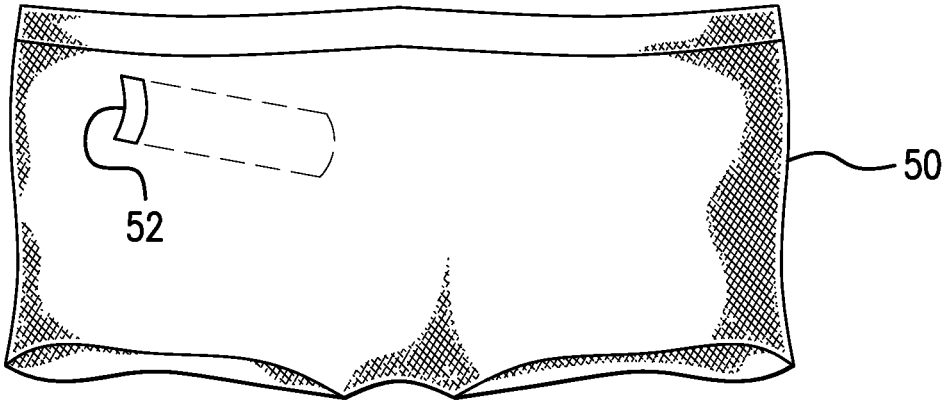
FIG. 5 is a front view of a boyshort style panty undergarment comprising a sleeve pocket, in accordance with various embodiments of the present invention.

FIG. 5 is a front view of a boyshort style panty undergarment 50 comprising a sleeve pocket 52, in accordance with various embodiments of the present invention.

Figure 6A:
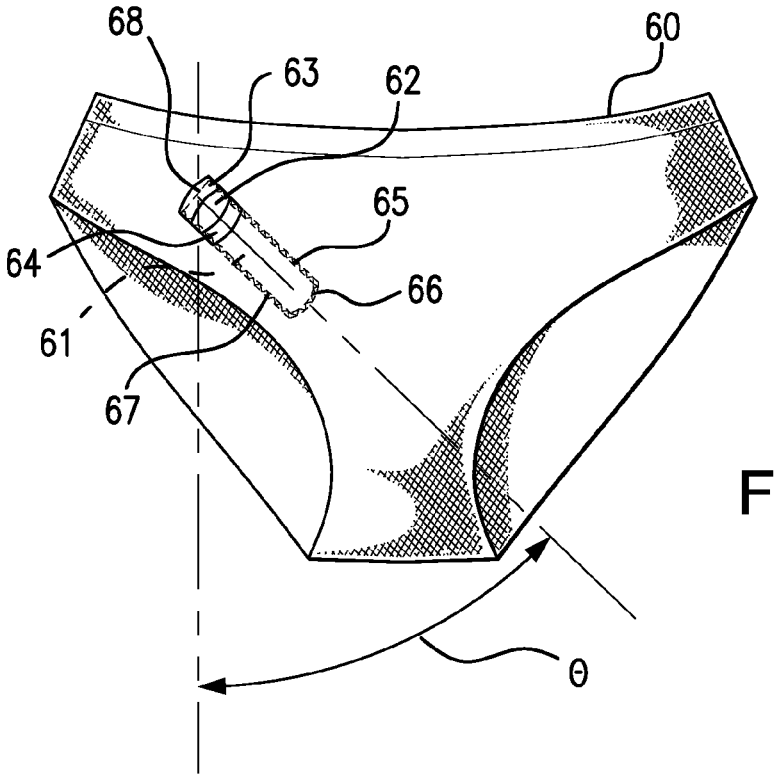
FIG. 6A is a front view of a bikini style panty undergarment comprising a sleeve pocket, in accordance with various embodiments of the present invention.

FIG. 6A is a front view of a bikini style panty undergarment 60 comprising a sleeve pocket 61, in accordance with various embodiments of the present invention. An opening 62 to sleeve pocket 61 can be defined between a first flap 63 and a second, opposing flap 64. First flap 63 can be useful for maintaining a tampon in sleeve pocket 61 and preventing the tampon from falling out of sleeve pocket 61. During manufacture, sleeve pocket 61 can be formed separately from the remainder of the undergarment and then attached to the inside surface of the undergarment front panel. Sleeve pocket 61 can be sewn to the inside surface of the front panel at seam lines 65, 66, 67, and 68. When worn by a wearer standing upright, sleeve pocket 61 can be angled with respect to a vertical line, at an angle Θ. In the embodiment shown, angle Θ is about 40°, although angle Θ could be any angle that provides a comfortable fit for a wearer, particularly when a tampon is in sleeve pocket 61. In some cases, angle Θ can be from about 20° to about 60°, from about 30° to about 50°, from about 35° to about 45°, or from about 38° to about 42°.

Figure 6B:
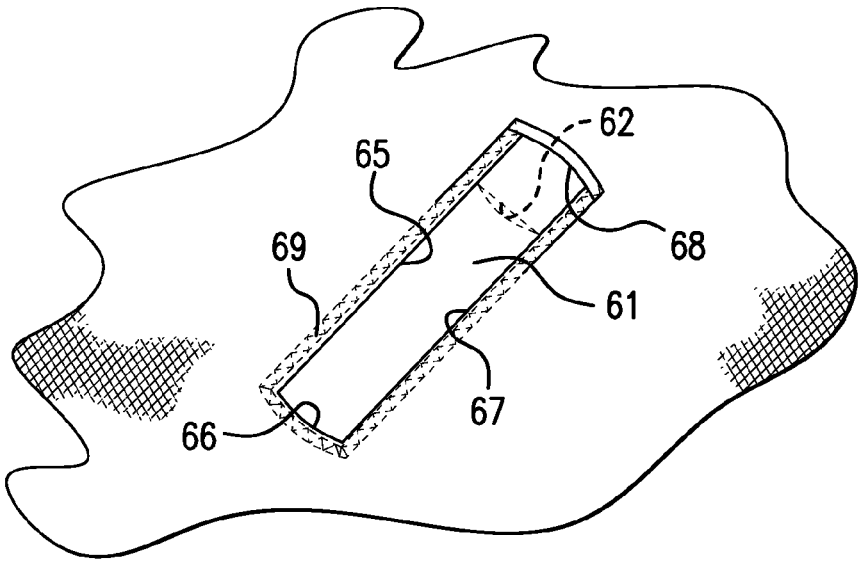
FIG. 6B is an enlarged, inside-out view of a portion of the bikini style panty undergarment of FIG. 6A showing the seams used for connection of the sleeve pocket to the front panel of the undergarment.

FIG. 6B is an enlarged, inside-out view of a portion of the front panel of bikini style panty undergarment 60 shown in FIG. 6A. Seam lines 65, 66, 67, and 68 are shown, and as can be seen, are separate from and spaced inward with respect to hem line 69 that is used to form sleeve pocket 61. In FIG. 6B, opening 62 to sleeve pocket 61 is shown in phantom lines as it cannot otherwise be seen from the inside front panel of the undergarment.

In some embodiments, sleeve pocket 61 comprises two layers of material. Only the back layer of the two layers is sewn to bikini style panty undergarment 60 at seam line 68, whereas only the front layer of material is sewn at a different seam line adjacent to an opening or slit in the front panel of the undergarment.

Figure 7A:
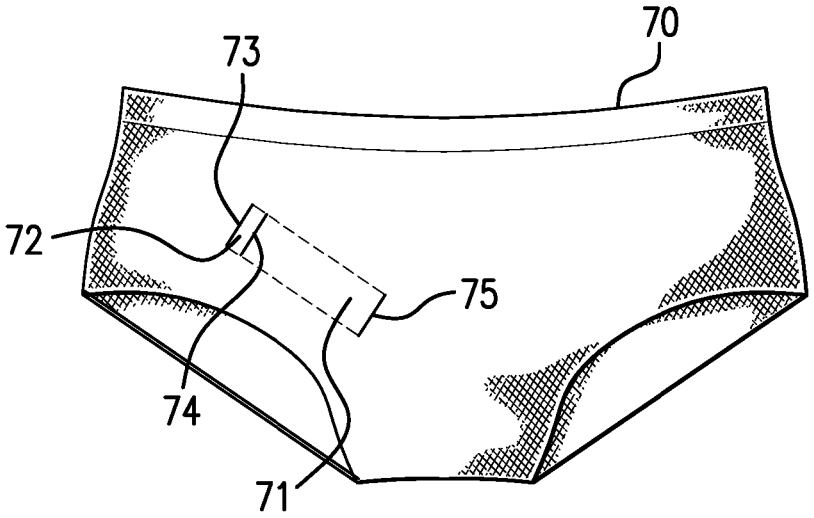
FIG. 7A is a front view of a hipster style panty undergarment comprising a sleeve pocket, in accordance with various embodiments of the present invention.
Figure 7B:
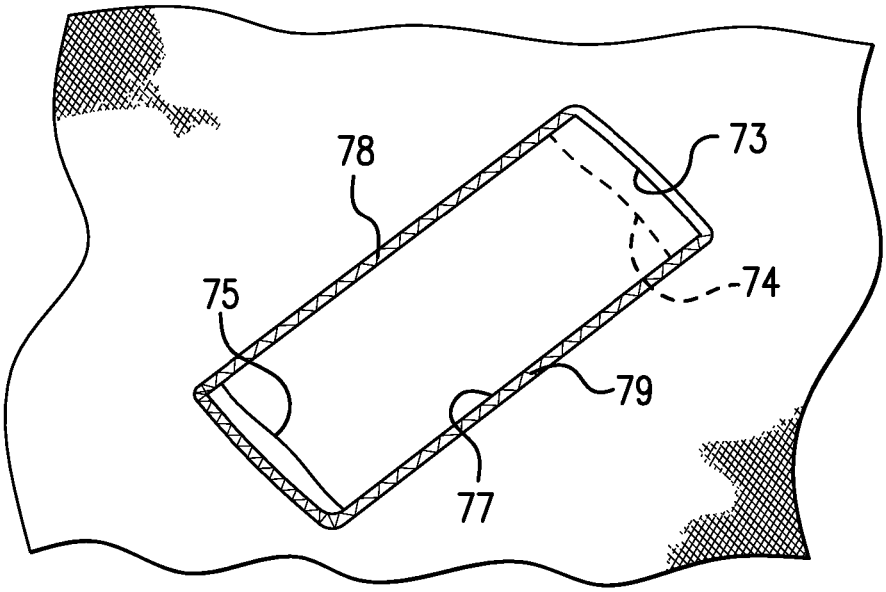
FIG. 7B is an enlarged, inside-out view of a portion of the hipster style panty undergarment of FIG. 7A showing the seams used for connection of the sleeve pocket to the front panel of the undergarment.

FIG. 7A is a front view of a hipster style panty undergarment 70 comprising a sleeve pocket 71, in accordance with various embodiments of the present invention. Sleeve pocket 71 is shown in phantom lines because it is hidden from view by the front panel of the undergarment. FIG. 7B is an enlarged, inside-out view of a portion of hipster style panty undergarment 70 shown in FIG. 7A, showing the seams used for connection of sleeve pocket 71 to the front panel of the undergarment.

In the embodiment shown in FIGS. 7A and 7B, sleeve pocket 71 is attached to the front panel of hipster style panty undergarment 70 at only the opposite ends of sleeve pocket 71. Sleeve pocket 71 comprises two layers of material. Both layers of material are sewn to the front panel of hipster style panty undergarment 70 at seam line 75. Only the back layer of the two layers is sewn to the front panel of hipster style panty undergarment 70 at seam line 73, whereas only the front layer of material is sewn to the front panel of hipster style panty undergarment 70 at seam line 74. As can be seen, opening 72 to sleeve pocket 71 is situated between seam lines 73 and 74. One or more flaps can be provided at opening 72, for example, which share or comprise seam lines 73 and/or 74. Any flaps that may be included can comprise an elastic material. As opposed to the embodiment shown in FIGS. 6A and 6B, sleeve pocket 71 is not sewn to the front panel of hipster style panty undergarment 70 along the sides 78 and 79 of sleeve pocket hem line 77.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A girl's panty comprising an undergarment and a sleeve pocket, the undergarment having a garment front adapted to be positioned adjacent to a front crotch region of a wearer when worn, a garment front center, a garment top, a garment bottom, a torso opening at the garment top, a pair of leg openings each of which intersects with the garment bottom, a first garment side adapted to be positioned adjacent to a first side region of a pelvic of the wearer when worn, and a second garment side adapted to be positioned adjacent to a second side region of the pelvic of the wearer when worn, the sleeve pocket having a length and a width and comprising a pocket opening facing the first garment side and a pocket bottom adjacent the garment front center, the pocket opening comprising an elastic material and the sleeve pocket being attached to the garment at the garment front adjacent to the garment top and the first garment side, the sleeve pocket being elongated in a first axis extending from the pocket opening to the pocket bottom and the first axis is angled downwardly diagonally along the garment front between the first garment side toward the garment front center, the sleeve pocket being designed for retaining a tampon-with-applicator, the length being from about 2.0 inches to about 5.0 inches and the width being from about 0.5 inch to about 1.0 inch such that the sleeve pocket has a sleeve shape, the sleeve pocket being attached to the undergarment in a position such that, when the girl's panty is worn by a wearer standing upright, the sleeve pocket is angled at an angle of from about 20 degrees to about 60 degrees with respect to a vertical line extending from the leg opening toward the garment top, the sleeve pocket is adapted to be elongated along a crease between an inner thigh of the wearer and an abdomen of the wearer, and the sleeve pocket is adapted to contact a crease between an inner thigh of the wearer and an abdomen of the wearer.

2. The girl's panty of claim 1, wherein the sleeve pocket comprises the opening and a sleeve, the sleeve pocket is secured to the undergarment only at the opening, and the sleeve pocket is reversible.

3. The girl's panty of claim 1, wherein the undergarment comprises a cotton material.

4. The girl's panty of claim 1, wherein the sleeve pocket comprises a same material as the undergarment.

5. The girl's panty of claim 1, wherein the sleeve pocket comprises a different material than the undergarment.

6. The girl's panty of claim 1, wherein the length is from about 3.0 inches to about 4.0 inches.

7. The girl's panty of claim 1, wherein the opening has a width, and the width of the opening is about 0.75 inch.

8. The girl's panty of claim 1, wherein, when worn by a wearer standing upright, the sleeve pocket is angled with respect to a vertical line, at an angle of from about 30° to about 50°.

9. The girl's panty of claim 1, wherein, when worn by a wearer standing upright, the sleeve pocket is angled with respect to a vertical line, at an angle of from about 35° to about 45°.

10. The girl's panty of claim 1, wherein, when worn by a wearer standing upright, the sleeve pocket is angled with respect to a vertical line, at an angle of about 40°.

* * * * *